US011674392B2

(12) United States Patent
Chen et al.

(10) Patent No.: US 11,674,392 B2
(45) Date of Patent: Jun. 13, 2023

(54) SPLIT AIR CABIN VENTILATION SYSTEM FOR CONSTRUCTION OF TUNNEL INCLINED SHAFT AND VENTILATION METHOD USING SAME

(71) Applicants: CHINA RAILWAY BEIJING ENGINEERING GROUP CO., LTD, Beijing (CN); The No.1 Engineering Co., Ltd of China Railway Beijing Engineering Group, Shaanxi (CN); CHANG'AN UNIVERSITY, ShaanXi (CN)

(72) Inventors: Shuangqin Chen, Shaanxi (CN); Jun Li, Shaanxi (CN); Runzhi Jia, Shaanxi (CN); Feng Cheng, Shaanxi (CN); Yaqiong Wang, Shaanxi (CN); Jiaqi Li, Shaanxi (CN); Rui Ren, Shaanxi (CN); Wei Long, Shaanxi (CN); Xitong Bai, Shaanxi (CN)

(73) Assignees: CHINA RAILWAY BEIJING ENGINEERING GROUP CO., LTD, Beijing (CN); The No. 1 Engineering Co., Ltd of China Railway Beijing Engineering Group, Xi'an (CN); CHANG'AN UNIVERSITY, Xi'an (CN)

( * ) Notice: Subject to any disclaimer, the term of this patent is extended or adjusted under 35 U.S.C. 154(b) by 11 days.

(21) Appl. No.: 17/212,293

(22) Filed: Mar. 25, 2021

(65) Prior Publication Data

US 2021/0207481 A1 Jul. 8, 2021

(30) Foreign Application Priority Data

Dec. 16, 2020 (CN) ..... 202011492094.0

(51) Int. Cl.
*E21F 1/00* (2006.01)
*E21F 1/14* (2006.01)
(Continued)

(52) U.S. Cl.
CPC ..... *E21F 1/006* (2013.01); *E21F 1/08* (2013.01); *E21F 1/14* (2013.01); *E21D 9/02* (2013.01); *E21F 1/003* (2013.01); *E21F 5/00* (2013.01)

(58) Field of Classification Search
CPC ... E21F 1/006; E21F 1/00; E21F 1/003; E21F 1/08; E21F 1/10; E21F 1/12; E21F 1/14;
(Continued)

(56) References Cited

FOREIGN PATENT DOCUMENTS

CN 201100132 Y * 8/2008
CN 101368483 A * 2/2009 ..... E21C 41/16
(Continued)

*Primary Examiner* — Janine M Kreck
*Assistant Examiner* — Michael A Goodwin

(57) ABSTRACT

A split air cabin ventilation system for construction of tunnel inclined shafts, including a first air cabin and a second air cabin which are both in a hollow closed structure with an air inlet end and an air outlet end respectively at both sides. The two air outlet ends are arranged away from each other. An end of the split air cabin is provided with an air inlet, and the other end is provided with an air outlet. The air inlet is connected to an air source, and the air outlet is connected to the air inlet ends of the first and second air cabins, respectively. The air inlet end of the first air cabin is connected to another air source.

8 Claims, 2 Drawing Sheets

(51) Int. Cl.
*E21F 1/08* (2006.01)
*E21F 5/00* (2006.01)
*E21D 9/02* (2006.01)

(58) Field of Classification Search
CPC . E21F 1/145; E21F 5/00; E21F 17/103; F24F 2007/002; E21C 41/16; E21C 41/18; E21C 41/20; E21C 41/22; E21C 41/24; E21C 35/223; E21D 9/02
See application file for complete search history.

(56) References Cited

FOREIGN PATENT DOCUMENTS

| | | | | | | |
|---|---|---|---|---|---|---|
| CN | 101761352 | A | * | 6/2010 | ..... | E21C 41/16 |
| CN | 205349398 | U | * | 6/2016 | | |
| CN | 205689234 | U | | 11/2016 | | |
| CN | 208203331 | U | | 12/2018 | | |
| CN | 209115139 | U | | 7/2019 | | |
| DE | 10300387 | A1 | * | 7/2004 | ..... | E21C 41/16 |
| KR | 1387998 | B1 | * | 4/2014 | | |
| WO | WO-2021024196 | A1 | * | 2/2021 | | |

* cited by examiner

SPLIT AIR CABIN VENTILATION SYSTEM FOR CONSTRUCTION OF TUNNEL INCLINED SHAFT AND VENTILATION METHOD USING SAME

CROSS-REFERENCE TO RELATED APPLICATIONS

This application claims the benefit of priority from Chinese Patent Application No. 202011492094.0, filed on Dec. 16, 2020. The content of the aforementioned application, including any intervening amendments thereto, is incorporated herein by reference in its entirety.

TECHNICAL FIELD

This application relates to ventilation tools for tunnel construction, and more particularly to a split air cabin ventilation system for construction of a tunnel inclined shaft and a ventilation method using the same.

BACKGROUND

With the vigorous development of the highway transportation and the high-speed railway construction, the design and construction of the extra-long mountain tunnels is constantly performed. To improve the construction progress and efficiency, several tunnel faces are often opened by vertical/inclined shafts for separate excavation when the mileage of a single tunnel is too long. The tunnel face opened by the tunnel inclined shaft is excavated commonly by drilling and blasting due to the limitation of the construction space and geological conditions, which will generate a large amount of dust and smoke during the construction. When the single side ventilation distance is too long, pollutants such as dust cannot be removed in time due to the closeness of the tunnel construction environment and the particularity of the inclined shaft structure, which significantly affects the health of operators in the tunnel.

Generally, a left tunnel face and a right tunnel face can be opened up by the inclined shaft, and there is a great difference in the excavating distances at the two sides of the inclined shaft due to the effect of geological conditions and construction. If a traditional fan-wind pipe forced air supply method is adopted, the fan at the side with a short excavating distance does not need to run at full load, while the fan at the side with a long excavating distance needs to run at full load, and even a relay fan needs to be provided, resulting in low overall utilization efficiency of fan, great loss of air energy and increased construction costs.

The return air from the two tunnel faces gathers at the intersection of the inclined shaft and the main tunnel, since there is a certain included angle between the inclined shaft and the main tunnel. If there is no guiding device at the intersection, the air will experience a turbulent flow and a decrease in velocity, and the dust and other particles will be suspended and settled, so that they cannot be quickly discharged outside the tunnel, seriously affecting the construction and operation environment in the tunnel.

In view of the above-mentioned problems in the tunnel construction ventilation, a split air cabin ventilation system for the construction of a tunnel inclined shaft is proposed.

SUMMARY

An object of this application is to provide a split air cabin ventilation system for construction of a tunnel inclined shaft and a ventilation method using the same to solve the defects of low overall utilization of fan, great loss of wind energy and high construction cost in the prior art.

The technical solutions of this application are described as follows.

In a first aspect, this application provides a split air cabin ventilation system for construction of a tunnel inclined shaft, comprising:

a first air cabin;

a second air cabin; and a split air cabin;

wherein the first air cabin and the second air cabin are both a hollow closed air cabin, and a first air inlet end and a first air outlet end are provided at two sides of the first air cabin, respectively; a second air inlet end and a second air outlet are provided at two sides of the second air cabin, respectively; the first air outlet end of the first air cabin is arranged away from the second air outlet end; and one end of the split air cabin is provided with a first air inlet, and the other end of the split air cabin is provided with a first air outlet; the first air inlet is connected to a first air source, and the first air outlet is connected to the first air inlet end and the second air inlet end, respectively; and the first air inlet end is connected to a second air source.

In some embodiments, the first air inlet end comprises a second air inlet and a third air inlet; the second air inlet is connected to the second air source via a first ventilation pipe, and the third air inlet is connected to the first air outlet of the split air cabin via a first air inlet branch pipe.

In some embodiments, the second air inlet end is connected to the first air outlet of the split air cabin via a second air inlet branch pipe.

In some embodiments, the split air cabin ventilation system further comprises a first fan and a second fan; wherein the first fan is provided at the first air outlet end, and the second fan is provided at the second air outlet end.

In some embodiments, the first fan and the second fan are both a jet fan.

In some embodiments, the split air cabin is a hollow trapezoidal air cabin; the hollow trapezoidal air cabin comprises a first bottom end and a second bottom end; the first bottom end is larger than the second bottom end in area; the first air inlet is arranged at the second bottom end, and the first air outlet is arranged at the first bottom end.

In some embodiments, the split air cabin ventilation system further comprises an air curtain; the air curtain is vertically arranged between the first air cabin and the second air cabin.

In some embodiments, the air curtain is provided with a second air outlet; and a water spray system and an electrostatic dedusting device are provided at the second air outlet.

In some embodiments, a throttle valve is provided at the first air outlet.

In a second aspect, this application provides a ventilation method using the split air cabin ventilation system, comprising:

arranging the split air cabin ventilation system above an intersection of the tunnel inclined shaft and a main tunnel, and allowing the first air outlet end and the second air outlet end to face tunnel faces on both sides of the main tunnel, respectively;

supplying air to the split air cabin through the first air source, and supplying air to the first air cabin and the second air cabin through the first air outlet of the split air cabin, respectively; supplying air to the first air cabin through the second air source; adjusting an air supply from the split air cabin to the first air cabin and the second air cabin to ensure that an air output of the first air cabin reaches a required air flow of a tunnel face at one side of the main tunnel, and an air output of the second air cabin reaches a required air flow of a tunnel face at the other side of the main tunnel.

Compared to the prior art, this application has the following beneficial effects.

This application provides a split air cabin ventilation system for construction of a tunnel inclined shaft, and two independent wind cabins are arranged. The distance of single side ventilation is effectively shortened by supplying air to the two independent wind cabins by the split wind cabin, which has lower requirements on the configuration of fans and air hoses and fan selection, thereby benefiting the multiple recycling of ventilation equipment. It can also greatly shorten the distance of single side ventilation, and effectively reduce ventilation resistance, ventilation energy consumption and operating cost of ventilation equipment. The ventilation system of this application can be used in projects where the construction lengths of the main tunnel at both sides of the tunnel inclined shaft differ greatly. The air supply to tunnel faces on two sides of the main tunnel is adjusted through split complementary ventilation, which can reasonably adjust the overall air supply volume on the premise of meeting the requirements of construction ventilation, thereby effectively improving the overall utilization efficiency of the fan.

Furthermore, by arranging an air curtain, the interaction of the return air flow at both sides can be effectively isolated during ventilation of tunnel inclined shaft. The air flow at the intersection of the inclined shaft and the main tunnel is guided to form a stable return air, and the wind loss is reduced, which is extremely conducive to the discharge of the dirty air flow inside the tunnel.

Moreover, a water spray system and an electrostatic dedusting device added at the second air outlet of the air curtain can effectively reduce the dust concentration in the tunnel and optimize the construction environment in the tunnel. Compared with the physical guiding device, the air curtain guiding device does not occupy construction space and will not interfere with the construction machinery for normal construction, ensuring the normal operation of tunnel construction.

In addition, by setting throttle valves at the first air inlet branch pipe and the second air inlet branch pipe, the total amount of air output is equal to the air input of the split air cabin base on the law of conservation of mass. The opening degree of the throttle valves at the two air inlet branch pipes can be dynamically controlled according to the on-site construction progress, which can directly control the air inlet volume of the two air hoses, so as to distribute the air inlet volume of the air cabin on both sides.

Figure 1:
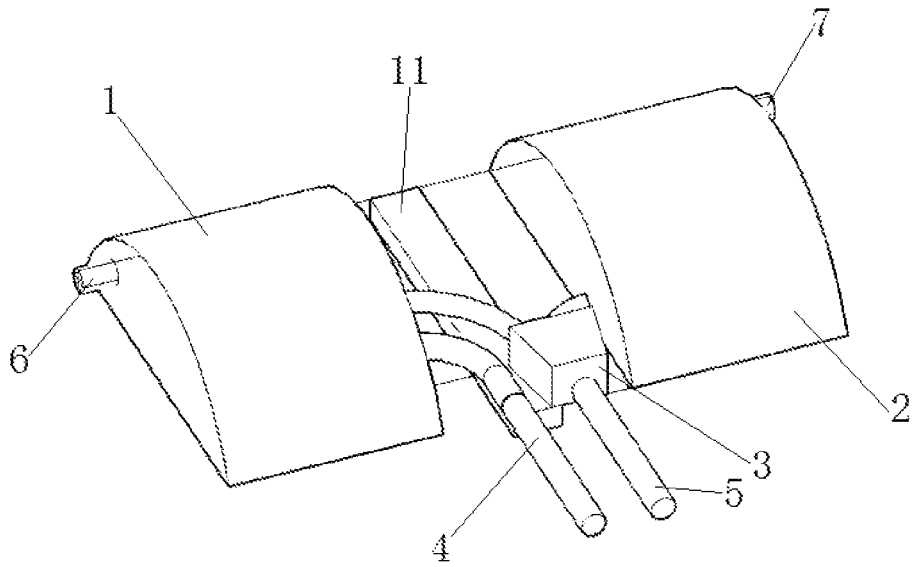
FIG. 1 is a front view of a split air cabin ventilation system according to an embodiment of the present disclosure.

In the drawings, 1, first air cabin; 2, second air cabin; 3, split air cabin; 4, first ventilation pipe; 5, second ventilation pipe; 6, first fan; 7, second fan; 8, first air inlet branch pipe; 9, second air inlet branch pipe; 10, throttle valve; and 11, air curtain.

DETAILED DESCRIPTION OF EMBODIMENTS

In order to render the objects, technical solutions and beneficial effects of the disclosure clearer, the disclosure will be described below in detail with reference to embodiments. It should be understood that these embodiments are merely illustrative of the disclosure, and are not intended to limit the disclosure.

This application provides a split air cabin ventilation system for construction of a tunnel inclined shaft, including: a first air cabin 1, a second air cabin 2, a split air cabin 3, a first ventilation pipe 4, a second ventilation pipe 5, a first fan 6, a second fan 7, a first air inlet branch pipe 8, a second air inlet branch pipe 9, a throttle valve 10 and an air curtain 11.

One end of the split air cabin 3 is provided with a first air inlet, and the other end of the split air cabin 3 is provided with a first air outlet. The first air inlet is connected to a first air source, and the first air outlet is connected to the first air inlet end and the second air inlet end, respectively; and the first air inlet end is connected to a second air source. The first air cabin 1 and the second air cabin 2 are arranged symmetrically. The first air cabin 1 and the second air cabin 2 are both a hollow closed air cabin. A first air inlet end and a first air outlet end are provided at two sides of the first air cabin 1, respectively; a second air inlet end and a second air outlet end are provided at two sides of the second air cabin 2, respectively; The first air outlet end of the first air cabin 1 is arranged away from the second air outlet end.

The first air inlet end includes a second air inlet and a third air inlet; the second air inlet is connected to the second air source via a first ventilation pipe 4, and the third air inlet is connected to the first air outlet of the split air cabin 3 via a first air inlet branch pipe 8. The second air inlet end is connected to the first air outlet of the split air cabin 3 via a second air inlet branch pipe 9.

A throttle valve is provided between the first air inlet branch pipe 8 and the first air outlet of the split air cabin 3, and a throttle valve is provided between the second air inlet branch pipe 9 and the first air outlet of the split air cabin 3. The total air output is equal to the air input of the split air cabin 3 based on the law of conservation of mass. The throttle valves at the two air inlet branch pipes can be dynamically controlled according to the on-site construction progress, which can directly control the air inlet volume of the two air hoses, so as to distribute the air inlet volume of the air cabin on both sides.

The first fan 6 is provided at the first air outlet end, and the second fan 7 is provided at the second air outlet end. Specifically, the first fan and the second fan are both a jet fan. When the ventilation distance is too long and the air supply pressure is insufficient, the air flow can be pressured again by the jet fan to ensure that the fresh air flow is smoothly transported to the tunnel face on both sides of the main tunnel.

In some embodiments, the split air cabin 3 is a hollow trapezoidal air cabin. The hollow trapezoidal air cabin comprises a first bottom end and a second bottom end; the first bottom end is larger than the second bottom end in area. The first air inlet is arranged at the second bottom end, and the first air outlet is arranged at the first bottom end. The hollow trapezoidal air cabin adopted here can effectively reduce the ventilation resistance and air loss of the air cabin.

The air curtain 11 is vertically arranged between the first air cabin 1 and the second air cabin 2, and the air curtain 11 is an integral air curtain. When the main tunnel of the inclined shaft is ventilated, the air curtain 11 is arranged below the middle of the first air cabin 1 and the second air cabin 2. The air curtain 11 is also arranged at the intersection between the tunnel inclined shaft and the main tunnel to form a dynamic air curtain barrier, which can effectively isolate the return air flow at both sides of the tunnel from each other. The air flow at the intersection of the inclined shaft and the main tunnel is guided to form a stable return air, and the wind loss is reduced, which is extremely conducive to the discharge of the dirty air flow inside the tunnel.

The working principle and ventilation method are described as follows.

The split air cabin ventilation system of this application is arranged at the intersection of the tunnel inclined shaft and the main tunnel. The air outlet ends of the first air cabin 1 and the second air cabin 2 are arranged away from each other and face to the tunnel face on both sides of the main tunnel respectively, and are connected to the corresponding tunnel face via wind pipes. Two fans are arranged at the entrance of the tunnel inclined shaft as two independent air sources. When the fans are turn on, the air is fed to the first air cabin 1 and the split air cabin 3, respectively, through the first ventilation pipe 4 and the second ventilation pipe 5. The air flow enters the split air cabin 3 and then is divided. One of the divided air flows enters the first air cabin 1 via the first air inlet branch pipe 8, and the other divided air flow enters the second air cabin 2 via the second air inlet branch pipe 9. When the construction progress of the tunnel face on both sides of the main tunnel is quite different, the throttle valves arranged on the first air inlet branch pipe 8 and the second air inlet branch pipe 9 are adjusted accordingly. Part of the divided air flows enters the first air cabin 1 and the other part of the divided air flows enters the second air cabin 2 to meet the air requirements of the tunnel faces under different construction distances. At the same time, during the tunnel construction ventilation process, the air curtains 11 arranged below the middle of the first air cabin 1 and the second air cabin 2 is opened in the whole process to form a dynamic air curtain barrier at the intersection of the tunnel inclined shaft and the main tunnel, which effectively isolates the polluted return air flow on both sides of the tunnel face, guides the polluted air flow to smoothly pass through the tunnel inclined shaft, and discharges the polluted air flow out of the tunnel. It also can avoid the intersection of the air flow at the intersection of the tunnel inclined shaft and the main tunnel to form a vortex, resulting in high dust concentration in the tunnel and poor construction environment.

The split air cabin ventilation system for construction of a tunnel inclined shaft of this application, the air flow from one air source injects the first air cabin 1 via the first ventilation pipe 4, and the air flow from the other air source injects the split air cabin 3 via the second ventilation pipe 5. The air output of the two air outlets of the split air cabin 3 is controlled through the throttle valve 10. The air input of the first air cabin 1 and the second air cabin 2 are configured according to the actual needs. The air in the first air cabin 1 is pressurized through the first fan 6 and ejected, and the air in the second air cabin 2 is pressurized through the second fan 7 and ejected. The air outlets of the first fan 6 and the second fan 7 are delivered to the tunnel face through ventilation pipes. When the air curtain 11 is turned on, an air curtain can be formed in the tunnel section to block the return air flow on both sides, and guide the return air flow to form a stable passage.

In this application, the air supply volume can be reasonably configured according to the different construction lengths of the two tunnel faces of the main tunnel, which can effectively shorten the ventilation distance of the single side. It can effectively guide the air flow by using the air curtain to sort out the air flow in the tunnel, and has strong guiding significance for the inclined shaft ventilation in the tunnel construction.

Embodiment

Figure 2:
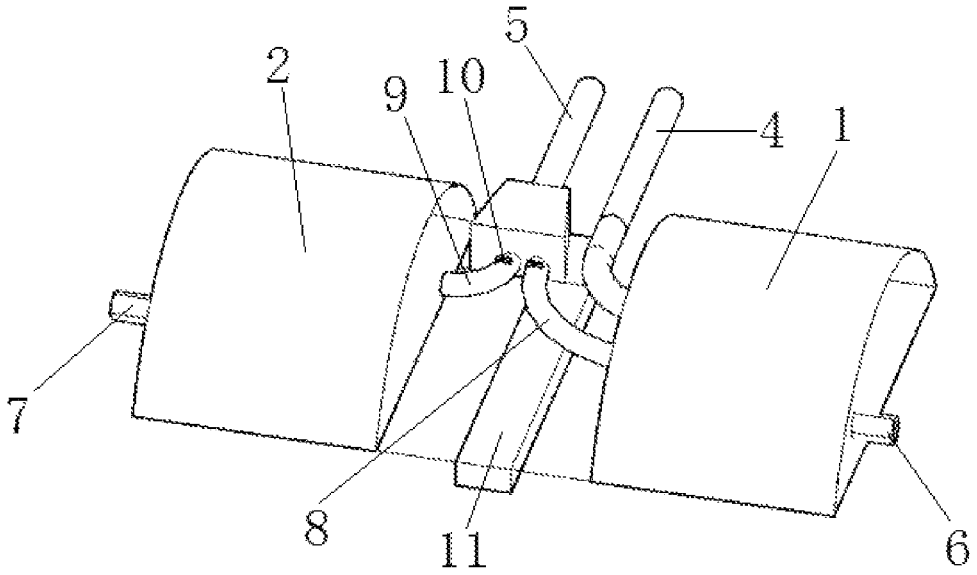
FIG. 2 is a rear view of the split air cabin ventilation system according to an embodiment of the present disclosure.
Figure 3:
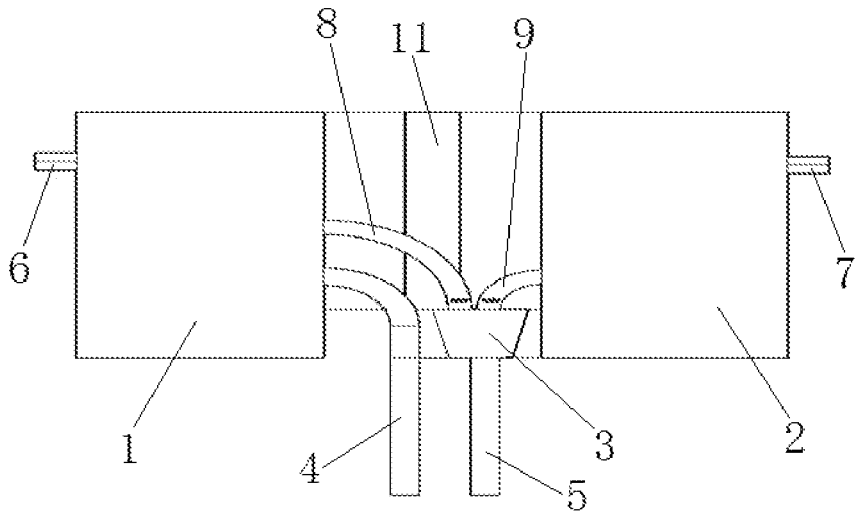
FIG. 3 is a top view of the split air cabin ventilation system according to an embodiment of the present disclosure.

As shown in FIGS. 1-3, this application provides a split air cabin ventilation system for construction of a tunnel inclined shaft, including: a first air cabin 1, a second air cabin 2, a split air cabin 3, a first ventilation pipe 4, a second ventilation pipe 5, a first fan 6, a second fan 7, a first air inlet branch pipe 8, a second air inlet branch pipe 9, a throttle valve 10 and an air curtain 11.

The first air cabin 1 and the second air cabin 2 are arranged at the intersection of a tunnel inclined shaft and a main tunnel symmetrically, and supply air face to both sides of the main tunnels. One side of the first air cabin 1 is provided with a first air inlet end and the other side is provided with a first air outlet end. The first air inlet end includes a second air inlet and a third air inlet. One side of the second air cabin 1 is provided with a second air inlet end and the other side is provided with a second air outlet end. The first air outlet end of the first air cabin 1 is arranged away from the second air outlet end.

The split air cabin 3 is arranged between the first air cabin 1 and the second air cabin 2, one end of the split air cabin 3 is provided with a first air inlet and the other end of the split air cabin 3 is provided with a first air outlet. The first air outlet of the split air cabin 3 includes a first air outlet hole and a second air outlet hole.

The second air inlet of the first air cabin 1 is connected to the first air source through the first ventilation pipe 4, and the first air inlet of the split air cabin 3 is connected to the second air source through the second ventilation pipe 5. The first ventilation pipe 4 and the second ventilation pipe 5 are ventilation hoses.

The third air inlet of the first air cabin 1 is connected to the first air outlet of the split air cabin 3 through the first air inlet branch pipe 8, and the end of the first air inlet branch pipe 8 is provided with a throttle valve 10. The air inlet of the second air cabin 2 is connected to the first air outlet of the split air cabin 3 through the second air inlet branch pipe 9, and the end of the second air inlet branch pipe 9 is provided with a throttle valve 10. The first air inlet branch pipe 8 and the second air inlet branch pipes 9 are steel ventilation pipes.

In some embodiments, the first air cabin 1 and the second air cabin 2 are both a hollow closed rigid body structure air cabins, and the split air cabin 3 is a steel trapezoidal split air cabin.

The air curtain 11 is vertically arranged between the first air cabin 1 and the second air cabin 2, and the air curtain 11 is an integral air curtain.

The split air cabin ventilation system of this application is aimed to solve the problems of long single-head ventilation distance, large air flow loss, different air demands at two ends, low overall utilization rate of the fan, turbulent air flow at the intersection of inclined shaft and the main tunnel and poor construction environment in the tunnel during the construction of inclined shaft in an extra-long tunnel.

The split air cabin ventilation system of this application introduces the clean air flow from the tunnel face with short construction distance to the other tunnel face with long construction distance using a split complementary method, so as to supplement the air demand of the tunnel face with long construction distance. The air demand of the two tunnel faces can be satisfied without additional fans outside the tunnel, which can indirectly reduce the number of fans and energy consumption. The air curtain 11 is arranged at the intersection of the tunnel inclined shaft and the main tunnel to form an air curtain, which can isolate the convergence of the polluted return air flow on both sides here and guide the air flow to smoothly pass through the inclined shaft and discharge it out of the tunnel. It can also improve the overall utilization of fans, sort out the air flow in the tunnel, improve the working environment in the tunnel, reduce overall ventilation energy consumption, and reduce construction ventilation maintenance and operating costs.

In the split air cabin ventilation system of this application, all components can be prefabricated according to the actual size at the construction site. All components can be assembled and disassembled at the site, and can be detached for repeated use after the construction.

Described above are only preferred embodiments of the present disclosure, and are not intended to limit the scope of the present disclosure. Any changes, modifications and improvements made by those skilled in the art without departing from the spirit of the present disclosure shall fall within the scope of the present disclosure.

What is claimed is:

1. A split air cabin ventilation system for construction of a tunnel inclined shaft, comprising:

a first air cabin;

a second air cabin; and a split air cabin;

wherein the first air cabin and the second air cabin are both a hollow closed air cabin; a first air inlet end and a first air outlet end are provided at two sides of the first air cabin, respectively; a second air inlet end and a second air outlet end are provided at two sides of the second air cabin, respectively; the first air outlet end of the first air cabin is arranged away from the second air outlet end;

the split air cabin is provided with a first air inlet and a first air outlet; the first air inlet is connected to a first air source, and the first air outlet is connected to the first air inlet end and the second air inlet end, respectively; and the first air inlet end is connected to a second air source; and the first air inlet end comprises a second air inlet and a third air inlet, and the second air inlet is connected to the second air source via a first ventilation pipe.

2. The split air cabin ventilation system of claim 1, wherein the third air inlet is connected to the first air outlet of the split air cabin via a first air inlet branch pipe.

3. The split air cabin ventilation system of claim 1, wherein the second air inlet end is connected to the first air outlet of the split air cabin via an air inlet branch pipe.

4. The split air cabin ventilation system of claim 1, further comprising:

a first fan; and a second fan;

wherein the first fan is provided at the first air outlet end, and the second fan is provided at the second air outlet end.

5. The split air cabin ventilation system of claim 4, wherein the first fan and the second fan are each a jet fan.

6. The split air cabin ventilation system of claim 1, wherein the split air cabin is a hollow trapezoidal air cabin; the hollow trapezoidal air cabin comprises a first end and a second end; the first end of the hollow trapezoidal air cabin is larger than the second end of the hollow trapezoidal air cabin in area; the first air inlet is arranged at the second end of the hollow trapezoidal air cabin, and the first air outlet is arranged at the first end of the hollow trapezoidal air cabin.

7. The split air cabin ventilation system of claim 1, wherein a throttle valve is provided at the first air outlet.

8. A ventilation method using the split air cabin ventilation system of claim 1, comprising:

arranging the split air cabin ventilation system, and allowing the first air outlet end and the second air outlet end to face in different directions, respectively;

supplying air to the split air cabin through the first air source, and supplying air to the first air cabin and the second air cabin through the first air outlet of the split air cabin, respectively; supplying air to the first air cabin through the second air source; adjusting an air supply from the split air cabin to the first air cabin and the second air cabin to ensure that an air output of the first air cabin reaches a first air flow, and an air output of the second air cabin reaches a second air flow.

* * * * *